US008692754B2

(12) United States Patent
Lee et al.

(10) Patent No.: US 8,692,754 B2
(45) Date of Patent: Apr. 8, 2014

(54) LCD PANEL WITH VISIBLE ZONE OF DUAL-GATE THIN FILM TRANSISTOR ARRAY

(75) Inventors: Hao-Chieh Lee, Hsin-Chu (TW); Yi-Suei Liao, Hsin-Chu (TW); Yih-Jen Hsu, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 231 days.

(21) Appl. No.: 13/166,132

(22) Filed: Jun. 22, 2011

(65) Prior Publication Data

US 2012/0120034 A1 May 17, 2012

(30) Foreign Application Priority Data

Nov. 11, 2010 (TW) ..... 99138884 A

(51) Int. Cl.
*G09G 3/36* (2006.01)

(52) U.S. Cl.
CPC ..... *G09G 3/3677* (2013.01); *G09G 3/3614* (2013.01); *G09G 2310/0213* (2013.01)
USPC ..... 345/87; 345/100; 345/96

(58) Field of Classification Search
USPC ..... 345/103, 87, 96, 98–100
See application file for complete search history.

(56) References Cited

U.S. PATENT DOCUMENTS

2006/0001638 A1* 1/2006 Jeon et al. ..... 345/100
2008/0180378 A1* 7/2008 Tang ..... 345/96
2011/0012887 A1* 1/2011 Lee et al. ..... 345/212
2011/0169793 A1* 7/2011 Chen et al. ..... 345/87

FOREIGN PATENT DOCUMENTS

TW 201110085 3/2011

OTHER PUBLICATIONS

U.S. Appl. No. 12/684,905; Application Date: Jan. 9, 2010.

* cited by examiner

*Primary Examiner* — Allison W Johnson
(74) *Attorney, Agent, or Firm* — WPAT, PC; Justin King

(57) ABSTRACT

A LCD panel includes an invisible zone and a visible zone. The invisible zone includes a gate driver and a wiring zone, wherein the gate driver sequentially outputs six pulse signals. By the wiring zone, a first pulse signal is converted into a first gate driving signal of the visible zone, a second pulse signal is converted into a fourth gate driving signal of the visible zone, a third pulse signal is converted into a fifth gate driving signal of the visible zone, a fourth pulse signal is converted into a second gate driving signal of the visible zone, a fifth pulse signal is converted into a third gate driving signal of the visible zone, and a sixth pulse signal is converted into a sixth gate driving signal of the visible zone.

15 Claims, 6 Drawing Sheets

LCD PANEL WITH VISIBLE ZONE OF DUAL-GATE THIN FILM TRANSISTOR ARRAY

TECHNICAL FIELD

The present invention relates to a LCD panel, and more particularly to a LCD panel integrating a gate on array (GOA) circuit and having a specified arrangement of sub-pixels.

DESCRIPTION OF THE RELATED ART

FIG. 1A is a schematic diagram illustrating a LCD panel integrating a gate on array (GOA) circuit according to the prior art. Generally, the LCD panel integrating the GOA circuit usually comprises an invisible zone and a visible zone 100. The invisible zone comprises a gate driver 120 and a wiring zone 110. The visible zone 100 is a dual-gate thin film transistor array.

Please refer to FIG. 1A again. The visible zone 100 comprises plural gate lines G1~G12, plural data lines D1~D3 and plural sub-pixels. These sub-pixels include red sub-pixels, green sub-pixels and blue sub-pixels. Each of the sub-pixels comprises a switching transistor and a storage unit. A control terminal of the switching transistor is connected with a corresponding gate line. The other two terminals of the switching transistor are connected with a corresponding data line and a corresponding storage unit, respectively.

Since the visible zone 100 is a dual-gate thin film transistor array, each row of sub-pixels are controlled by two gate lines, and each data line may provide color data to two sub-pixels of the same row of sub-pixels. For example, from left to right, the first sub-pixel is a red sub-pixel connected with the first gate line G1 and the first data line D1; the second sub-pixel is a green sub-pixel connected with the second gate line G2 and the first data line D1; the third sub-pixel is a blue sub-pixel connected with the first gate line G1 and the second data line D2; the fourth sub-pixel is a red sub-pixel connected with the second gate line G2 and the second data line D2; the fifth sub-pixel is a green sub-pixel connected with the first gate line G1 and the third data line D3; and the sixth sub-pixel is a blue sub-pixel connected with the second gate line G2 and the third data line D3.

In addition, the gate driver 120 comprises plural serially-connected shift registers 210~212. In response to clock signals CLK1~CLK6, the shift registers 210~212 sequentially generate pulse signals g1~g12.

The wiring zone 110 comprises plural layout traces. Through the layout traces, the pulse signals g1~g12 generated by the gate driver 120 may be transmitted to corresponding gate lines G1~G12, and the color data generated by a source driver (not shown) may be transmitted to the data lines D1~D3. As shown in FIG. 1A, the first pulse signal g1 is transmitted to the first gate line G1 and served as a first gate driving signal; the second pulse signal g2 is transmitted to the second gate line G2 and served as a second gate driving signal; and the rest may be deduced by analogy.

FIG. 1B is a schematic timing waveform diagram illustrating associated signals processed in the LCD panel integrating the GOA circuit according to the prior art. Without showing the actual values of the color data, the amplitudes of the data lines D1~D3 only indicate the polarities of the color data. In addition, the polarities of every two adjacent ones of the data lines D1~D3 at each time spot are opposite.

As shown in FIG. 1B, the pulse signals g1~g9 or the gate driving signals G1~G9 are sequentially generated, wherein each of the pulse signals g1~g9 or each of the gate driving signals G1~G9 is turned on for a duration of 1T. In addition, each of the data lines D1~D3 periodically outputs two color data with inversed polarities in every 2T time interval.

Consequently, after all of the pulse signals are transmitted to corresponding gate lines, all sub-pixels connected with the first data line D1 sequentially receive color data according to the sequence as shown in FIG. 1C (1st~12th). Firstly, the color data are sequentially received by the sub-pixels from left to right in the first row. Then, the color data are sequentially received by the sub-pixels from left to right in the second row. The rest may be deduced by analogy. The sub-pixels connected with other data lines sequentially receive color data according to the similar sequence. The polarities of all sub-pixels are shown in the visible zone 100 of FIG. 1A. For example, since the first sub-pixel in the first row is a red sub-pixel and the color data received by this sub-pixel has a positive polarity, the first color data is denoted as R(+).

In the conventional LCD panel integrating the GOA circuit, since the same data line provides color data to the left and right sub-pixels in the same row, some drawbacks may occur. For example, if the pulse signals are undercharged, the brightness values of the left and right sub-pixels are not uniformly distributed. Under this circumstance, obvious bright/dark fringes are shown on the frame.

Therefore, there is a need of providing an improved LCD panel integrating a gate on array (GOA) circuit.

SUMMARY

Therefore, the present invention provides a LCD panel integrating a gate on array (GOA) circuit, in which the polarity inversion cycle of the color data outputted from the source driver is adjusted and the layout traces of the wiring zone is cross-connected.

In accordance with an aspect, the present invention provides a LCD panel. The LCD panel includes an invisible zone and a visible zone. The invisible zone includes a gate driver and a wiring zone, wherein the gate driver sequentially outputs plural pulse signals. By the wiring zone, a (6n+1)-th pulse signal is converted into a (6n+1)-th gate driving signal, a (6n+2)-th pulse signal is converted into a (6n+4)-th gate driving signal, a (6n+3)-th pulse signal is converted into a (6n+5)-th gate driving signal, a (6n+4)-th pulse signal is converted into (6n+2)-th gate driving signal, a (6n+5)-th pulse signal is converted into a (6n+3)-th gate driving signal and a (6n+6)-th pulse signal is converted into a (6n+6)-th gate driving signal. The visible zone includes a data line, plural sub-pixels and plural gate lines for sequentially receiving the plural gate driving signals, wherein the plural sub-pixels are connected with the data line. A (6n+1)-th data is received by a (6n+1)-th sub-pixel in response to the (6n+1)-th gate driving signal. A (6n+2)-th data is received by a (6n+2)-th sub-pixel in response to the (6n+4)-th gate driving signal. A (6n+3)-th data is received by a (6n+3)-th sub-pixel in response to the (6n+5)-th gate driving signal. A (6n+4)-th data is received by a (6n+4)-th sub-pixel in response to the (6n+2)-th gate driving signal. A (6n+5)-th data is received by a (6n+5)-th sub-pixel in response to the (6n+3)-th gate driving signal. A (6n+6)-th data is received by a (6n+6)-th sub-pixel in response to the (6n+6)-th gate driving signal, where n is zero or a positive integer.

In accordance with another aspect, the present invention provides a LCD panel. The LCD panel includes an invisible zone and a visible zone. The invisible zone includes a gate driver and a wiring zone, wherein the gate driver sequentially outputs plural pulse signals. By the wiring zone, a (6n+1)-th pulse signal is converted into a (6n+1)-th gate driving signal, a (6n+2)-th pulse signal is converted into a (6n+4)-th gate driving signal, a (6n+3)-th pulse signal is converted into a (6n+5)-th gate driving signal, a (6n+4)-th pulse signal is converted into (6n+2)-th gate driving signal, a (6n+5)-th pulse signal is converted into a (6n+3)-th gate driving signal and a (6n+6)-th pulse signal is converted into a (6n+6)-th gate driving signal. The visible zone includes plural gates lines. A (6n+1)-th gate line, a (6n+4)-th gate line, a (6n+5)-th gate line, a (6n+2)-th gate line, a (6n+3)-th gate line and a (6n+6)-th gate line are sequentially enabled, thereby sequentially transmitting the (6n+1)-th gate driving signal, the (6n+4)-th gate driving signal, the (6n+5)-th gate driving signal, the (6n+2)-th gate driving signal, the (6n+3)-th gate driving signal and the (6n+6)-th gate driving signal, where n is zero or a positive integer.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2A:
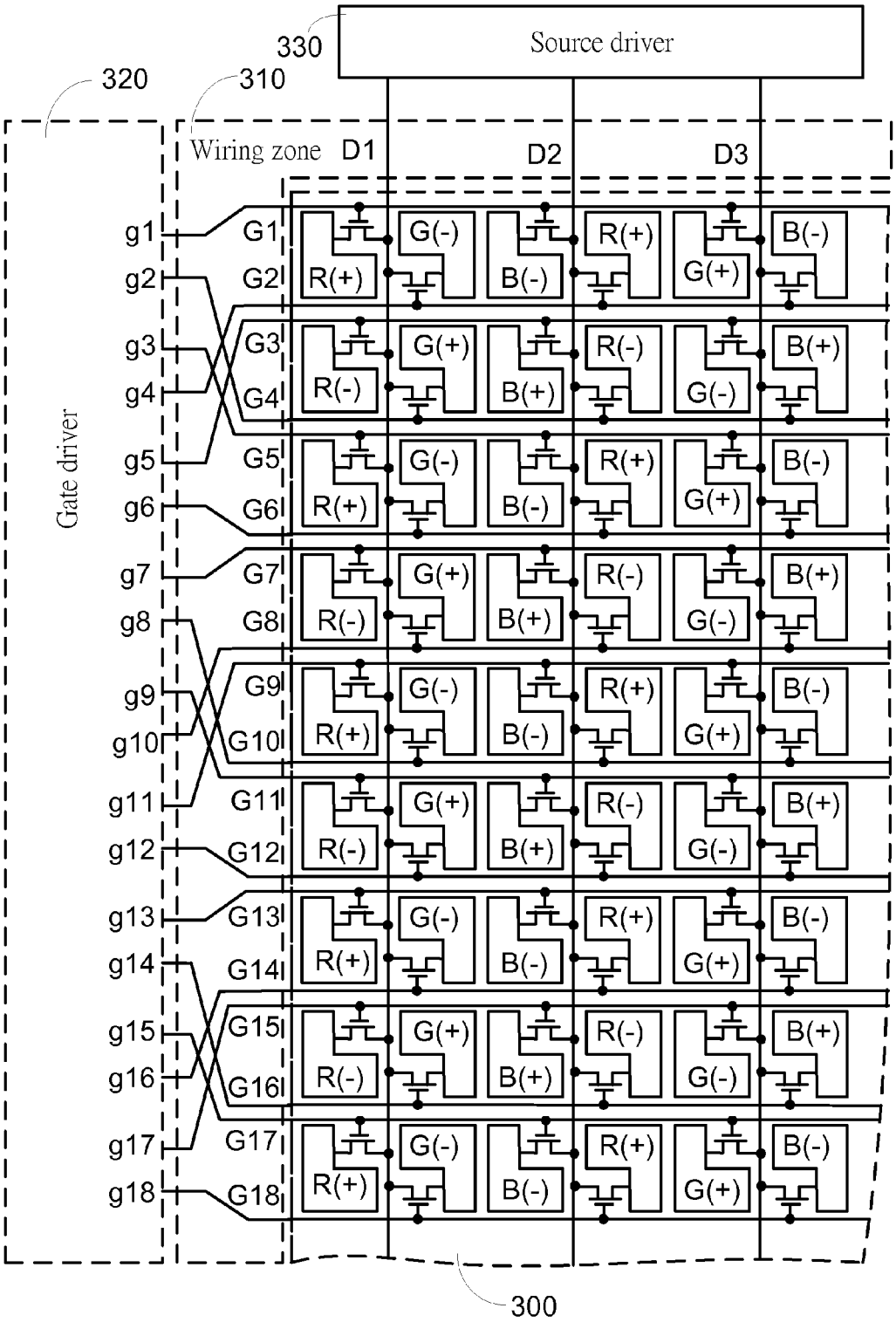
FIG. 2A is a schematic diagram illustrating a LCD panel integrating a gate on array (GOA) circuit according to an embodiment of the present invention.

FIG. 2A is a schematic diagram illustrating a LCD panel integrating a gate on array (GOA) circuit according to an embodiment of the present invention. Generally, the LCD panel integrating the GOA circuit usually comprises an invisible zone and a visible zone 300. The invisible zone comprises a gate driver 320 and a wiring zone 310. The visible zone 300 includes a dual-gate thin film transistor array. That is, as shown in FIG. 2A, the area circumscribed by a dashed line denotes the LCD panel. Moreover, the LCD panel is further connected with an external source driver 330.

Please refer to FIG. 2A again. The visible zone 300 comprises plural gate lines G1~G18, plural data lines D1~D3 and plural sub-pixels. These sub-pixels include red sub-pixels, green sub-pixels and blue sub-pixels. Each of the sub-pixels comprises a switching transistor and a storage unit. A control terminal of the switching transistor is connected with a corresponding gate line. The other two terminals of the switching transistor are connected with a corresponding data line and a corresponding storage unit, respectively.

Since the visible zone 300 is a dual-gate thin film transistor array, each row of sub-pixels are controlled by two gate lines, and each data line may provide color data to two sub-pixels of the same row of sub-pixels. For example, from left to right, the first sub-pixel is a red sub-pixel connected with the first gate line G1 and the first data line D1; the second sub-pixel is a green sub-pixel connected with the second gate line G2 and the first data line D1; the third sub-pixel is a blue sub-pixel connected with the first gate line G1 and the second data line D2; the fourth sub-pixel is a red sub-pixel connected with the second gate line G2 and the second data line D2; the fifth sub-pixel is a green sub-pixel connected with the first gate line G1 and the third data line D3; and the sixth sub-pixel is a blue sub-pixel connected with the second gate line G2 and the third data line D3. Moreover, the sub-pixels at the same column are same-color sub-pixels.

Figure 1A:
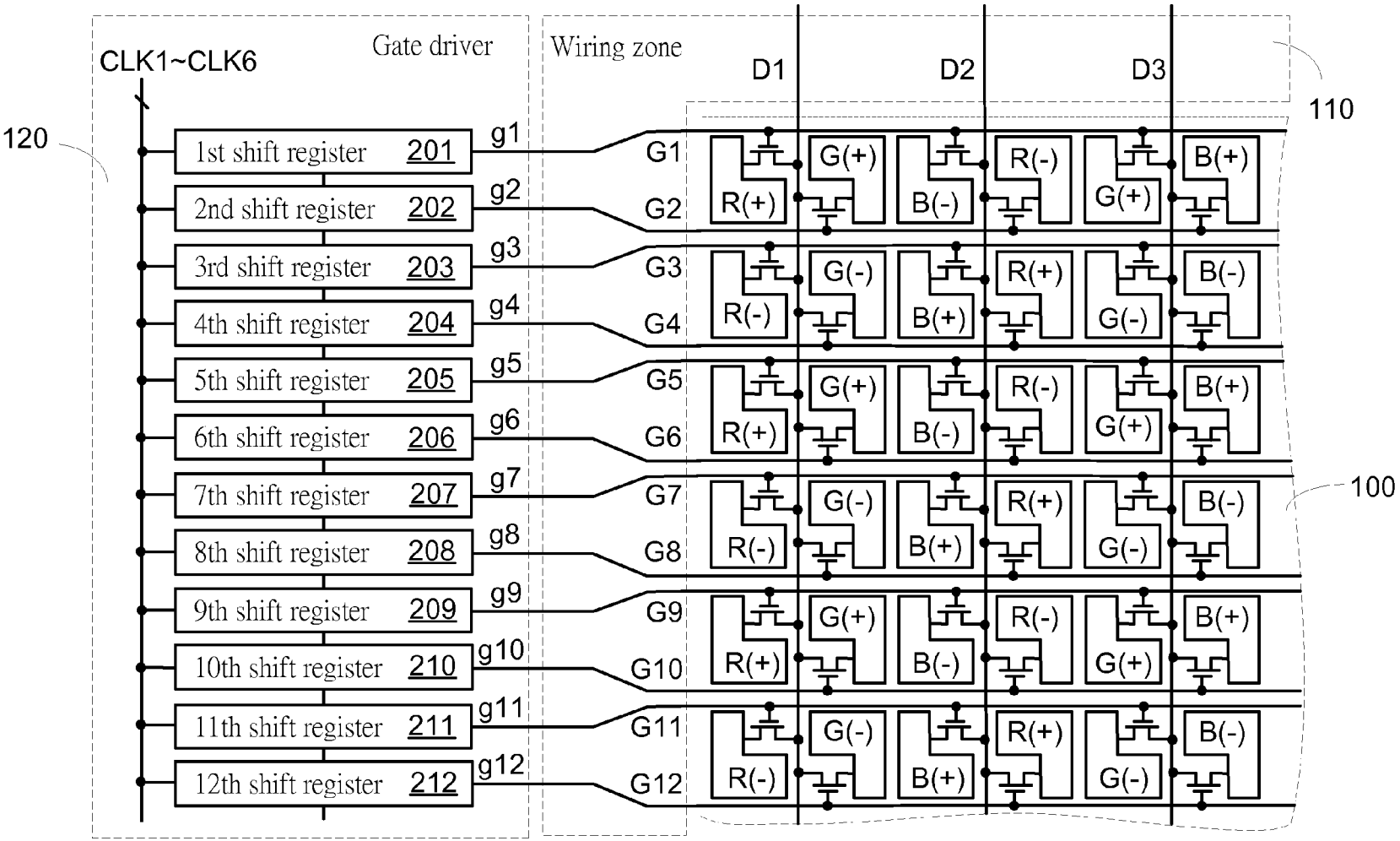
FIG.1A (Prior Art)
FIG. 1A is a schematic diagram illustrating a LCD panel integrating a gate on array (GOA) circuit according to the prior art.
Figure 1B:
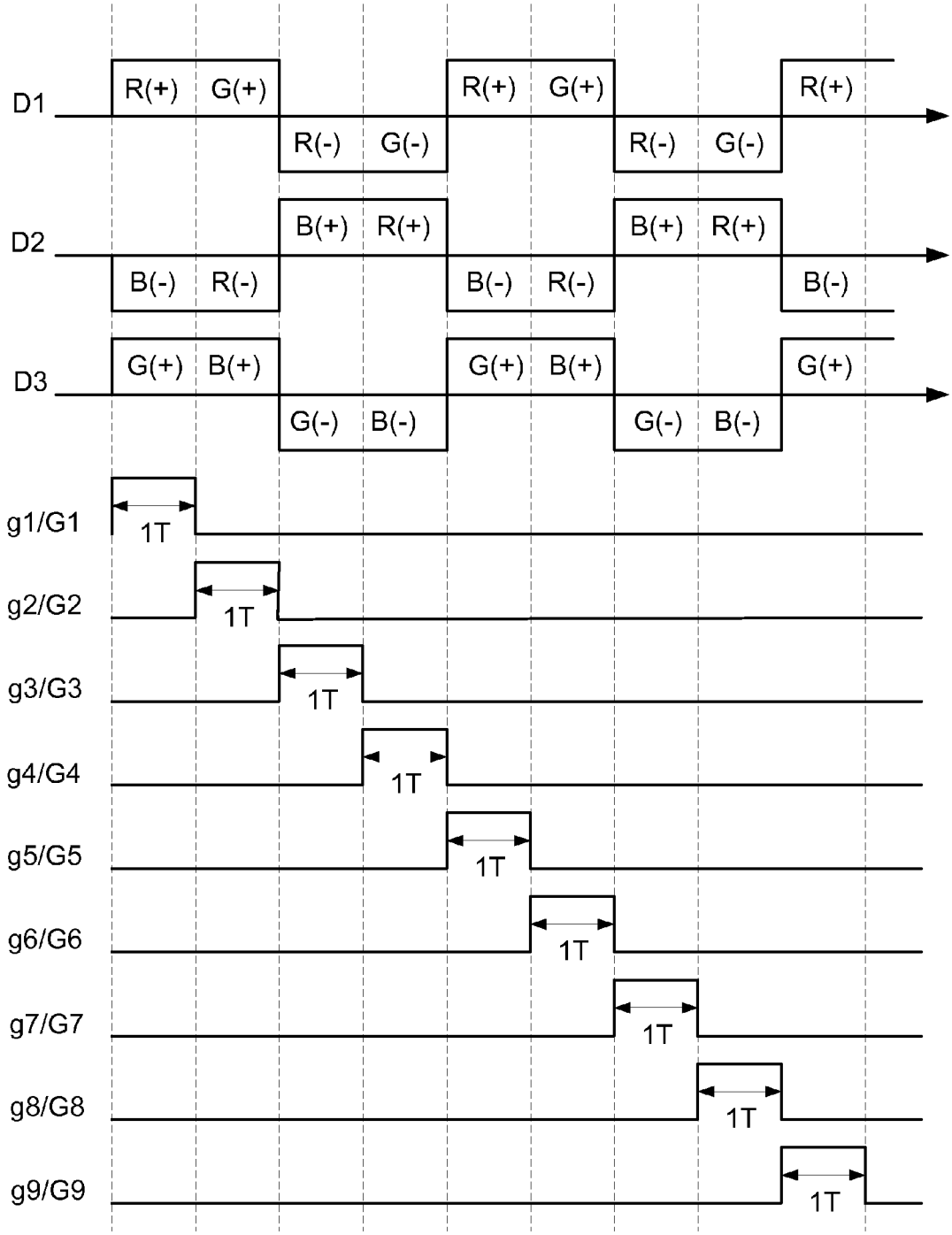
FIG.1B (Prior Art)
FIG. 1B is a schematic timing waveform diagram illustrating associated signals processed in the LCD panel integrating the GOA circuit according to the prior art.
Figure 1C:
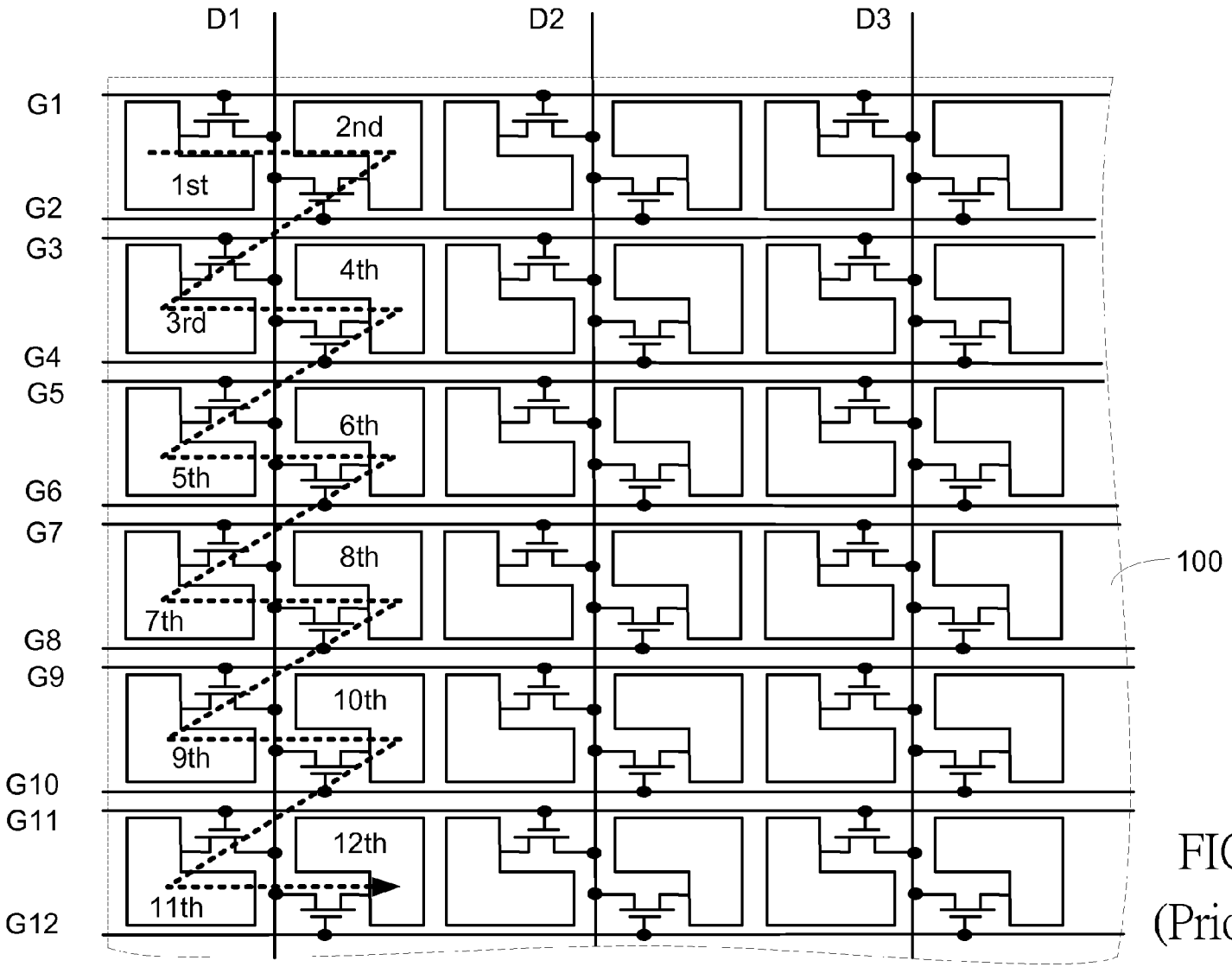
FIG.1C (Prior Art)
FIG. 1C is a schematic diagram illustrating the sequence of receiving the color data by the sub-pixels of the LCD panel integrating the GOA circuit according to the prior art.

The configurations and the functions of the gate driver 320 are identical to those of the gate driver of FIG. 1A, and are not redundantly described herein. In addition, the gate driver 320 may sequentially generate pulse signals g1~g18.

In this embodiment, the wiring zone 310 comprises plural layout traces. Every six layout traces are connected with corresponding six gate lines. As shown in FIG. 2A, the first pulse signal g1 is transmitted to the first gate line G1 and served as the first gate driving signal; the second pulse signal g2 is transmitted to the fourth gate line G4 and served as the fourth gate driving signal; the third pulse signal g3 is transmitted to the fifth gate line G5 and served as the fifth gate driving signal; the fourth pulse signal g4 is transmitted to the second gate line G2 and served as the second gate driving signal; the fifth pulse signal g5 is transmitted to the third gate line G3 and served as the third gate driving signal; and the sixth pulse signal g6 is transmitted to the sixth gate line G6 and served as the sixth gate driving signal.

The layout traces are divided into several groups, wherein each group comprises six layout traces. The relationship between the layout traces and the gate driving signals can be expressed by the following general formulae. That is, the (6n+1)-th pulse signal is transmitted to the (6n+1)-th gate line and served as the (6n+1)-th gate driving signal; the (6n+2)-th pulse signal is transmitted to the (6n+4)-th gate line and served as the (6n+4)-th gate driving signal; the (6n+3)-th pulse signal is transmitted to the (6n+5)-th gate line and served as the (6n+5)-th gate driving signal; the (6n+4)-th pulse signal is transmitted to the (6n+2)-th gate line and served as the (6n+2)-th gate driving signal; the (6n+5)-th pulse signal is transmitted to the (6n+3)-th gate line and served as the (6n+3)-th gate driving signal; and the (6n+6)-th pulse signal is transmitted to the (6n+6)-th gate line and served as the (6n+6)-th gate driving signal. In the above formulae, n is zero or a positive integer.

Figure 2B:
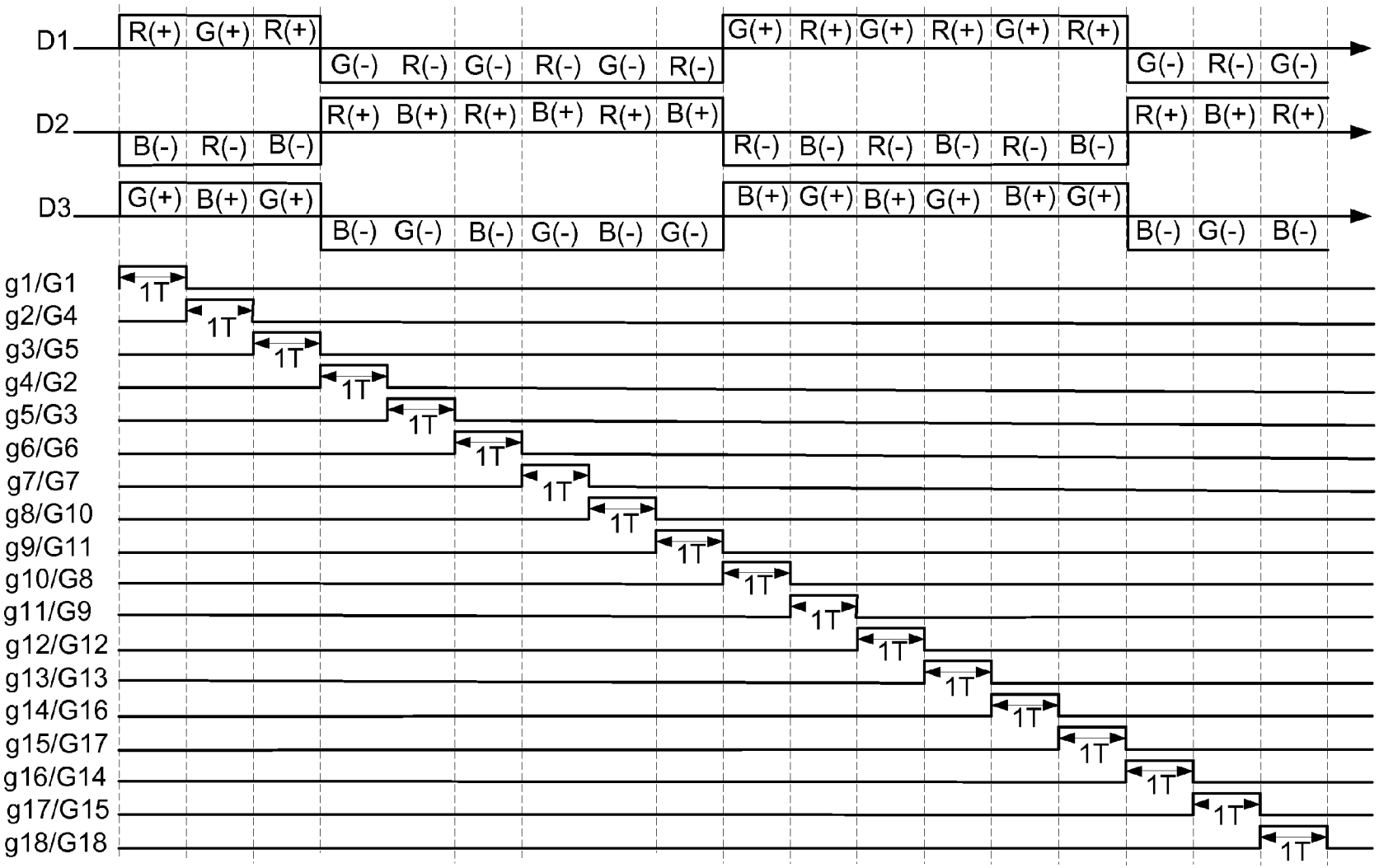
FIG. 2B is a schematic timing waveform diagram illustrating associated signals processed in the LCD panel integrating the GOA circuit according to the embodiment of the present invention.

FIG. 2B is a schematic timing waveform diagram illustrating associated signals processed in the LCD panel integrating the GOA circuit according to the embodiment of the present invention. Without showing the actual values of the color data, the amplitudes of the data lines D1~D3 only indicate the polarities of the color data. In addition, the polarities of every two adjacent ones of the data lines D1~D3 at each time spot are opposite.

As shown in FIG. 2B, the pulse signals g1~g18 or the gate driving signals are sequentially generated, wherein each of the pulse signals g1~g18 or each of the gate driving signals is turned on for a duration of 1T. Consequently, the pulse signals g1~g18 are sequentially transmitted to corresponding gate lines and served as corresponding gate driving signals. Moreover, for complying with the LCD panel of the present invention, each of the data lines D1~D3 of the source driver 330 outputs three same-polarity color data during the initial 3T time interval. Then, during the next 6T time interval, each of the data lines D1~D3 of the source driver 330 outputs six color data while changing the polarities. Then, during the next 6T time interval, each of the data lines D1~D3 of the source driver 330 outputs six color data while changing the polarities again.

Figure 2C:
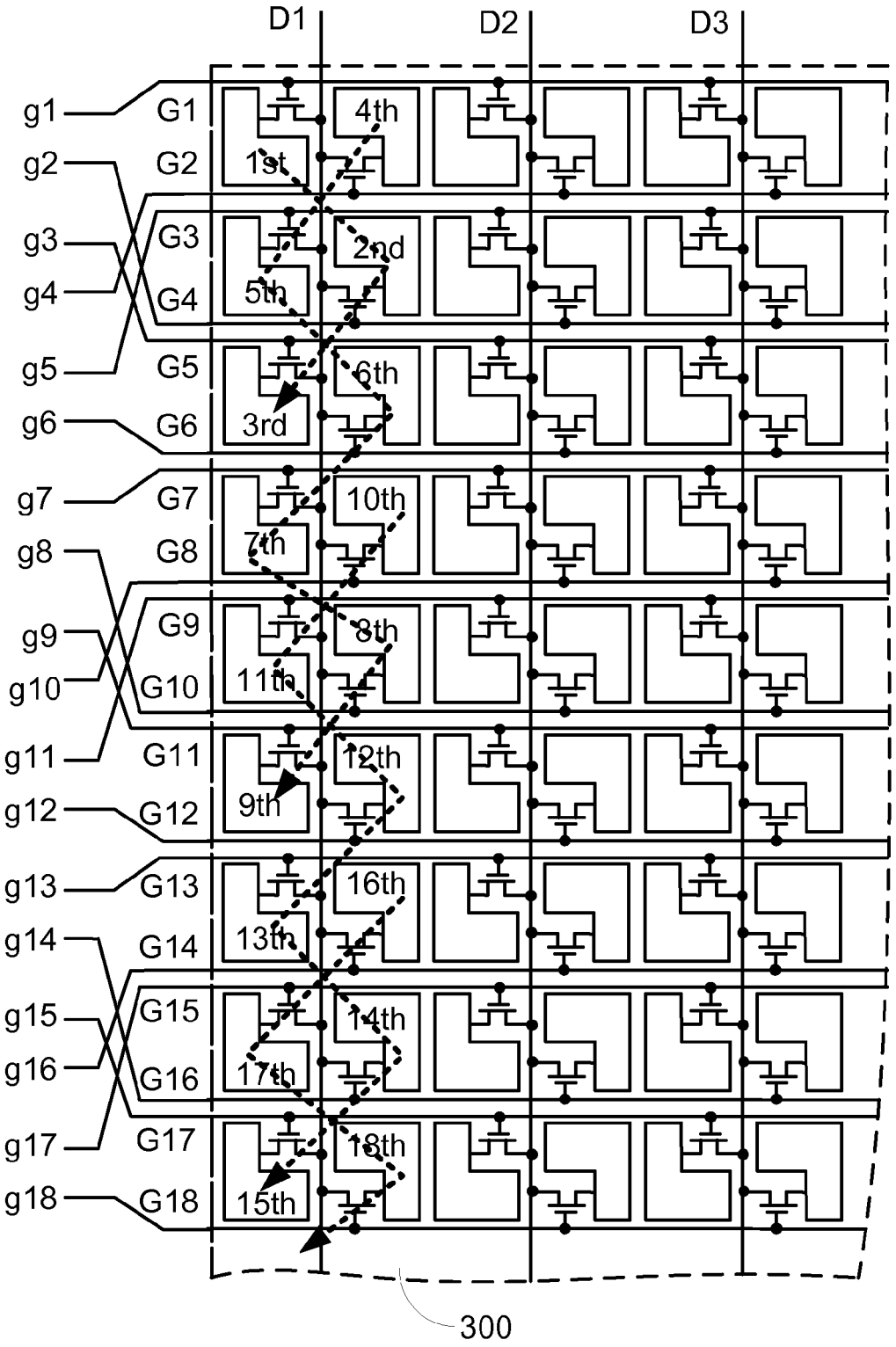
FIG. 2C is a schematic diagram illustrating the sequence of receiving the color data by the sub-pixels of the LCD panel integrating the GOA circuit according to the embodiment of the present invention.

Consequently, after all of the pulse signals are transmitted to corresponding gate lines, all sub-pixels connected with the first data line D1 sequentially receive color data according to the sequence as shown in FIG. 2C (1st~18th). Firstly, a first color data R(+) is received by a first sub-pixel (1st) in response to the first gate driving signal. Then, a second color date G(+) is received by a second sub-pixel (2nd) in response to the fourth gate driving signal. Then, a third color date R(+) is received by a third sub-pixel (3rd) in response to the fifth gate driving signal. Then, a fourth color date G(−) is received by a fourth sub-pixel (4th) in response to the fourth gate driving signal. Then, a fifth color date R(−) is received by a fifth sub-pixel (5th) in response to the third gate driving signal. Then, a sixth color date G(−) is received by a sixth sub-pixel (6th) in response to the sixth gate driving signal. The rest may be deduced by analogy.

Similarly, the sequence of receiving the color data by the sub-pixels of the LCD panel can be expressed by the following general formulae. Firstly, the (6n+1)-th data is received by the (6n+1)-th sub-pixel in response to the (6n+1)-th gate driving signal. Then, the (6n+2)-th data is received by the (6n+2)-th sub-pixel in response to the (6n+4)-th gate driving signal. Then, the (6n+3)-th data is received by the (6n+3)-th sub-pixel in response to the (6n+5)-th gate driving signal. Then, the (6n+4)-th data is received by the (6n+4)-th sub-pixel in response to the (6n+2)-th gate driving signal. Then, the (6n+5)-th data is received by the (6n+5)-th sub-pixel in response to the (6n+3)-th gate driving signal. Then, the (6n+6)-th data is received by the (6n+6)-th sub-pixel in response to the (6n+6)-th gate driving signal. In the above formulae, n is zero or a positive integer.

From the above discussion, the LCD panel integrating a gate on array (GOA) circuit according to the present invention has a specified arrangement of sub-pixels. By cross-connecting the layout traces of the wiring zone, the polarity inversion cycle of the color data outputted from the source driver is adjustable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A LCD panel, with a visible zone of a dual-gate thin film transistor array, comprising:

an invisible zone comprising a gate driver and a wiring zone, wherein the gate driver sequentially outputs plural pulse signals, and by the wiring zone, a (6n+1)-th pulse signal is converted into a (6n+1)-th gate driving signal, a (6n+2)-th pulse signal is converted into a (6n+4)-th gate driving signal, a (6n+3)-th pulse signal is converted into a (6n+5)-th gate driving signal, a (6n+4)-th pulse signal is converted into (6n+2)-th gate driving signal, a (6n+5)-th pulse signal is converted into a (6n+3)-th gate driving signal and a (6n+6)-th pulse signal is converted into a (6n+6)-th gate driving signal;

the visible zone of the dual-gate thin film transistor array, comprising a data line, plural sub-pixels and plural gate lines for sequentially receiving the plural gate driving signals, wherein the plural sub-pixels are connected with the data line, the sub-pixels in a same row are alternatively connected to two gate lines respectively, and the same data line is connected to two sub-pixels in a same row, wherein a (6n+1)-th data is received by a (6n+1)-th sub-pixel in response to the (6n+1)-th gate driving signal, a (6n+2)-th data is received by a (6n+2)-th sub-pixel in response to the (6n+4)-th gate driving signal, a (6n+3)-th data is received by a (6n+3)-th sub-pixel in response to the (6n+5)-th gate driving signal, a (6n+4)-th data is received by a (6n+4)-th sub-pixel in response to the (6n+2)-th gate driving signal, a (6n+5)-th data is received by a (6n+5)-th sub-pixel in response to the (6n+3)-th gate driving signal, and a (6n+6)-th data is received by a (6n+6)-th sub-pixel in response to the (6n+6)-th gate driving signal, where n is zero or a positive integer;

wherein the data line outputs three same-polarity data sequentially during an initial 3T time intervals, and then the data line outputs six data sequentially while changing polarities once every next 6T time intervals.

2. The LCD panel according to claim 1, wherein the (6n+1)-th data, the (6n+2)-th data and the (6n+3)-th data have positive polarities, and the (6n+4)-th data, the (6n+5)-th data and the (6n+6)-th data have negative polarities.

3. The LCD panel according to claim 1, wherein the (6n+1)-th data, the (6n+2)-th data and the (6n+3)-th data have negative polarities, and the (6n+4)-th data, the (6n+5)-th data and the (6n+6)-th data have positive polarities.

4. The LCD panel according to claim 1, wherein the gate driver comprises plural serially-connected shift registers for sequentially generating the plural pulse signals.

5. The LCD panel according to claim 1, wherein the (6n+1)-th data and the (6n+4)-th data are arranged in the same row, the (6n+5)-th data and the (6n+2)-th data are arranged in the same row, and the (6n+3)-th data and the (6n+6)-th data are arranged in the same row, wherein the (6n+1)-th data, the (6n+5)-th data and the (6n+3)-th data are arranged in the same column, and the (6n+4)-th data, the (6n+2)-th data and the (6n+6)-th data are arranged in the same column.

6. The LCD panel according to claim 1, wherein the wiring zone comprises plural layout traces, wherein through the layout traces, the (6n+1)-th pulse signal is transmitted to a (6n+1)-th gate line and served as the (6n+1)-th gate driving signal, the (6n+2)-th pulse signal is transmitted to a (6n+4)-th gate line and served as the (6n+4)-th gate driving signal, the (6n+3)-th pulse signal is transmitted to a (6n+5)-th gate line and served as the (6n+5)-th gate driving signal, the (6n+4)-th pulse signal is transmitted to a (6n+2)-th gate line and served as the (6n+2)-th gate driving signal, the (6n+5)-th pulse signal is transmitted to a (6n+3)-th gate line and served as the (6n+3)-th gate driving signal, and the (6n+6)-th pulse signal is transmitted to a (6n+6)-th gate line and served as the (6n+6)-th gate driving signal.

7. The LCD panel according to claim 1, wherein the (6n+1)-th sub-pixel comprises a switching transistor and a storage unit, wherein a control terminal of the switching transistor is operated in response to the (6n+1)-th gate driving signal, and the other two terminals of the switching transistor are respectively connected with the data line and the storage unit.

8. A LCD panel with a visible zone of a dual-gate thin film transistor array, comprising:

an invisible zone comprising a gate driver and a wiring zone, wherein the gate driver sequentially outputs plural pulse signals, and by the wiring zone, a (6n+1)-th pulse signal is converted into a (6n+1)-th gate driving signal, a (6n+2)-th pulse signal is converted into a (6n+4)-th gate driving signal, a (6n+3)-th pulse signal is converted into a (6n+5)-th gate driving signal, a (6n+4)-th pulse signal is converted into (6n+2)-th gate driving signal, a (6n+5)-th pulse signal is converted into a (6n+3)-th gate driving signal and a (6n+6)-th pulse signal is converted into a (6n+6)-th gate driving signal; and the visible zone of the dual-gate thin film transistor array comprising a data line, plural sub-pixels and plural gates lines, the sub-pixels in a same row are alternatively connected to two gate lines respectively, and the same data line is connected to two sub-pixels in a same row; wherein a (6n+1)-th gate line, a (6n+4)-th gate line, a (6n+5)-th gate line, a (6n+2)-th gate line, a (6n+3)-th gate line and a (6n+6)-th gate line are sequentially enabled, thereby sequentially transmitting the (6n+1)-th gate driving signal, the (6n+4)-th gate driving signal, the (6n+5)-th gate driving signal, the (6n+2)-th gate driving signal, the (6n+3)-th gate driving signal and the (6n+6)-th gate driving signal, where n is zero or a positive integer;

wherein the data line outputs three same-polarity data sequentially during an initial 3T time intervals, and then the data line outputs six data sequentially while changing polarities once every next 6T time intervals.

9. The LCD panel according to claim 8, wherein the visible zone further comprises a data line and plural sub-pixels, wherein the plural sub-pixels are connected with the data line, wherein a (6n+1)-th data is received by a (6n+1)-th sub-pixel in response to the (6n+1)-th gate driving signal, a (6n+2)-th data is received by a (6n+2)-th sub-pixel in response to the (6n+4)-th gate driving signal, a (6n+3)-th data is received by a (6n+3)-th sub-pixel in response to the (6n+5)-th gate driving signal, a (6n+4)-th data is received by a (6n+4)-th sub-pixel in response to the (6n+2)-th gate driving signal, a (6n+5)-th data is received by a (6n+5)-th sub pixel in response to the (6n+3)-th gate driving signal, and a (6n+6)-th data is received by a (6n+6)-th sub-pixel in response to the (6n+6)-th gate driving signal.

10. The LCD panel according to claim 9, wherein the (6n+1)-th data, the (6n+2)-th data and the (6n+3)-th data have positive polarities, and the (6n+4)-th data, the (6n+5)-th data and the (6n+6)-th data have negative polarities.

11. The LCD panel according to claim 9, wherein the (6n+1)-th data, the (6n+2)-th data and the (6n+3)-th data have negative polarities, and the (6n+4)-th data, the (6n+5)-th data and the (6n+6)-th data have positive polarities.

12. The LCD panel according to claim 9, wherein the (6n+1)-th data and the (6n+4)-th data are arranged in the same row, the (6n+5)-th data and the (6n+2)-th data are arranged in the same row, and the (6n+3)-th data and the (6n+6)-th data are arranged in the same row, wherein the (6n+1)-th data, the (6n+5)-th data and the (6n+3)-th data are arranged in the same column, and the (6n+4)-th data, the (6n+2)-th data and the (6n+6)-th data are arranged in the same column.

13. The LCD panel according to claim 9, wherein the (6n+1)-th sub-pixel comprises a switching transistor and a storage unit, wherein a control terminal of the switching transistor is operated according to the (6n+1)-th gate driving signal, and the other two terminals of the switching transistor are respectively connected with the data line and the storage unit.

14. The LCD panel according to claim 8, wherein the wiring zone comprises plural layout traces, wherein through the layout traces, the (6n+1)-th pulse signal is transmitted to a (6n+1)-th gate line and served as the (6n+1)-th gate driving signal, the (6n+2)-th pulse signal is transmitted to a (6n+4)-th gate line and served as the (6n+4)-th gate driving signal, the (6n+3)-th pulse signal is transmitted to a (6n+5)-th gate line and served as the (6n+5)-th gate driving signal, the (6n+4)-th pulse signal is transmitted to a (6n+2)-th gate line and served as the (6n+2)-th gate driving signal, the (6n+5)-th pulse signal is transmitted to a (6n+3)-th gate line and served as the (6n+3)-th gate driving signal, and the (6n+6)-th pulse signal is transmitted to a (6n+6)-th gate line and served as the (6n+6)-th gate driving signal.

15. The LCD panel according to claim 8, wherein the gate driver comprises plural serially-connected shift registers for sequentially generating the plural pulse signals.

* * * * *